US006244942B1

(12) United States Patent
Zuniga

(10) Patent No.: US 6,244,942 B1
(45) Date of Patent: Jun. 12, 2001

(54) CARRIER HEAD WITH A FLEXIBLE MEMBRANE AND ADJUSTABLE EDGE PRESSURE

(75) Inventor: Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/349,834

(22) Filed: Jul. 8, 1999

Related U.S. Application Data

(63) Continuation-in-part of application No. 09/200,492, filed on Nov. 25, 1998, and a continuation-in-part of application No. 09/169,500, filed on Oct. 9, 1998.

(51) Int. Cl.[7] ..... B24B 7/22
(52) U.S. Cl. ..... 451/288; 451/398
(58) Field of Search ..... 451/288, 287, 451/398, 41, 388, 285, 289

(56) References Cited

U.S. PATENT DOCUMENTS

| | | | | |
|---|---|---|---|---|
| 4,918,869 | | 4/1990 | Kitta | 51/131.1 |
| 5,193,316 | | 3/1993 | Olmstead | 51/281 |
| 5,205,082 | | 4/1993 | Shendon et al. | 51/237 |
| 5,423,716 | | 6/1995 | Strasbaugh | 451/388 |
| 5,449,316 | | 9/1995 | Strasbaugh | 451/289 |
| 5,584,751 | | 12/1996 | Kobayashi et al. | 451/288 |
| 5,605,488 | * | 2/1997 | Ohashi et al. | 451/288 |
| 5,624,299 | * | 4/1997 | Shendon | 451/288 |
| 5,643,053 | | 7/1997 | Shendon | 451/28 |
| 5,643,061 | | 7/1997 | Jackson et al. | 451/289 |
| 5,759,918 | | 6/1998 | Hoshizaki et al. | 438/692 |
| 5,803,799 | | 9/1998 | Volodarsky et al. | 451/288 |
| 5,851,140 | * | 12/1998 | Barns et al. | 451/288 |
| 5,879,220 | | 3/1999 | Hasegawa et al. | 451/288 |
| 5,957,751 | * | 9/1999 | Govzman et al. | 451/289 |
| 5,964,653 | * | 10/1999 | Perlov et al. | 451/285 |
| 5,993,302 | * | 11/1999 | Chen et al. | 451/398 |
| 6,056,632 | * | 5/2000 | Mitchel et al. | 451/289 |

FOREIGN PATENT DOCUMENTS

| | | |
|---|---|---|
| 0 841 123 A1 | 5/1998 | (EP) . |
| 2243263 | 9/1990 | (JP) . |
| WO 99/07516 | 2/1999 | (WO) . |

OTHER PUBLICATIONS

U.S. application No. 09/200,492, filed Nov. 25, 1998.
U.S. application No. 09/169,500, filed Oct. 9, 1998.

* cited by examiner

*Primary Examiner*—Robert A. Rose
(74) *Attorney, Agent, or Firm*—Fish & Richardson

(57) ABSTRACT

A carrier head for a chemical mechanical polishing apparatus has a base, a flexible membrane extending beneath the base to define a pressurizable chamber, a retaining ring, and a spacer ring. At least one of the retaining ring and the spacer includes a projection or an indentation positioned adjacent a portion of the membrane that extends over the spacer, so that the pressure applied at a perimeter of the first membrane portion differs from the pressure applied in center of the first membrane portion.

26 Claims, 5 Drawing Sheets

CARRIER HEAD WITH A FLEXIBLE MEMBRANE AND ADJUSTABLE EDGE PRESSURE

CROSS-REFERENCE TO RELATED APPLICATIONS

This is a continuation-in-part of U.S. application Ser. No. 09/200,492, filed Nov. 25, 1998, and a continuation-in-part of U.S. application Ser. No. 09/169,500 filed Oct. 9, 1998, each of which is incorporated herein by reference in its entirety.

BACKGROUND

The present invention relates generally to chemical mechanical polishing of substrates, and more particularly to a carrier head with a flexible membrane.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect," i.e., the tendency of the substrate edge to be polished at a different rate than the substrate center. The edge effect can results in either overpolishing (the removal of too much material from the substrate) or underpolishing (the removal of too little material) at the substrate perimeter, e.g., the outermost five to ten millimeters of a 200 millimeter (mm) wafer.

SUMMARY

In general, in one aspect, the invention is directed a carrier head for a chemical mechanical polishing apparatus. The carrier head has a base, a retaining ring secured to the base, an annular spacer positioned beneath the base, a first flexible membrane portion extending beneath the base and the spacer to define a pressurizable chamber, and a second flexible membrane portion extending over the spacer. The first membrane portion has a lower surface that provides a mounting surface for a substrate, and an edge portion secured between the base and the retaining ring. At least one of the retaining ring and the spacer includes a projection or an indentation positioned adjacent the second membrane portion to adjust the pressure applied at a perimeter of the first membrane portion.

Implementations of the invention may include one or more of the following features. The first and second membrane portions may be portions of a single flexible membrane. The flexible membrane may extend inwardly beneath a lower surface of the spacer, upwardly around an inner surface of the spacer, and outwardly above an upper surface of the spacer. A volume between the first membrane portion and the portion of the flexible membrane that extends inwardly beneath the lower surface of the spacer may define a pressurizable pocket. A support structure may be positioned inside the chamber. The spacer may include a flange that extends over the support structure.

In another aspect, the invention is directed to a method of polishing a substrate. In the method, a substrate is positioned against a first flexible membrane portion of a carrier head. The first flexible membrane portion extends beneath a base and a spacer in the carrier head to define a pressurizable chamber. The chamber is pressurized so that a second flexible membrane portion extending over the spacer and having an edge portion secured between the base and a retaining ring applies a downward pressure to the spacer. At least one of the retaining ring and the spacer includes a projection or an indentation positioned adjacent the second membrane portion, so that the pressure applied at a perimeter of the first membrane portion differs from the pressure applied in center of the first membrane portion.

Advantages of the invention may include the following. Non-uniform polishing of the substrate can be reduced, and the resulting flatness and finish of the substrate are improved. A single pressure control can be used to adjust the polishing rates at the center and edge of the substrate.

Other advantages and features of the invention will be apparent from the following description, including the drawings and claims.

BRIEF DESCRIPTION OF THE DRAWINGS

Like reference numbers are designated in the various drawings to indicate like elements. A primed reference number indicates that an element has a modified function, operation or structure.

DETAILED DESCRIPTION

Figure 1:
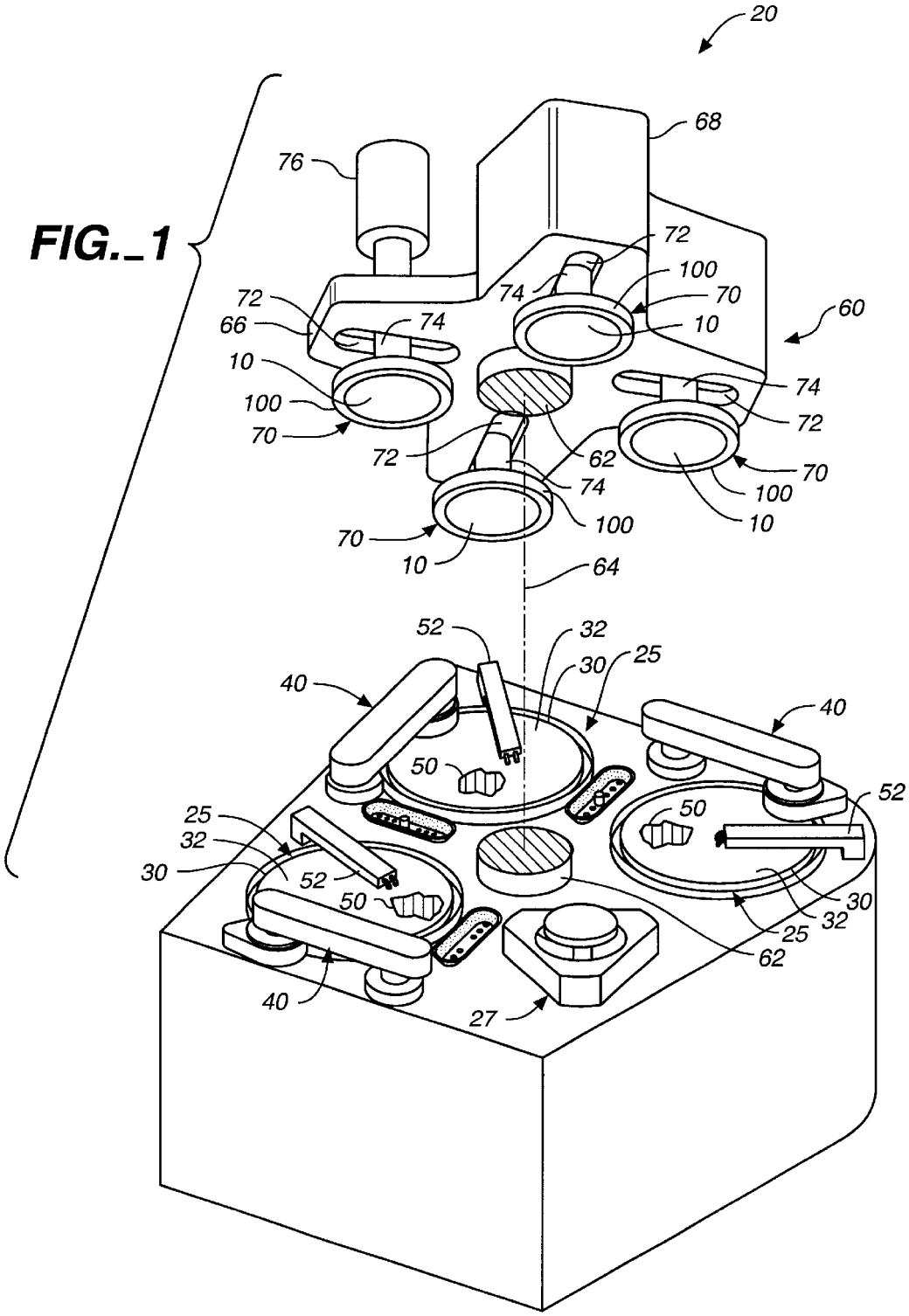
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 and polishing pad 32 may also be about twenty inches in diameter if substrate 10 is a six-inch (150 millimeter) diameter disk. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations. One of the carrier head systems receives a substrate from and delivers the substrate to the transfer station. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
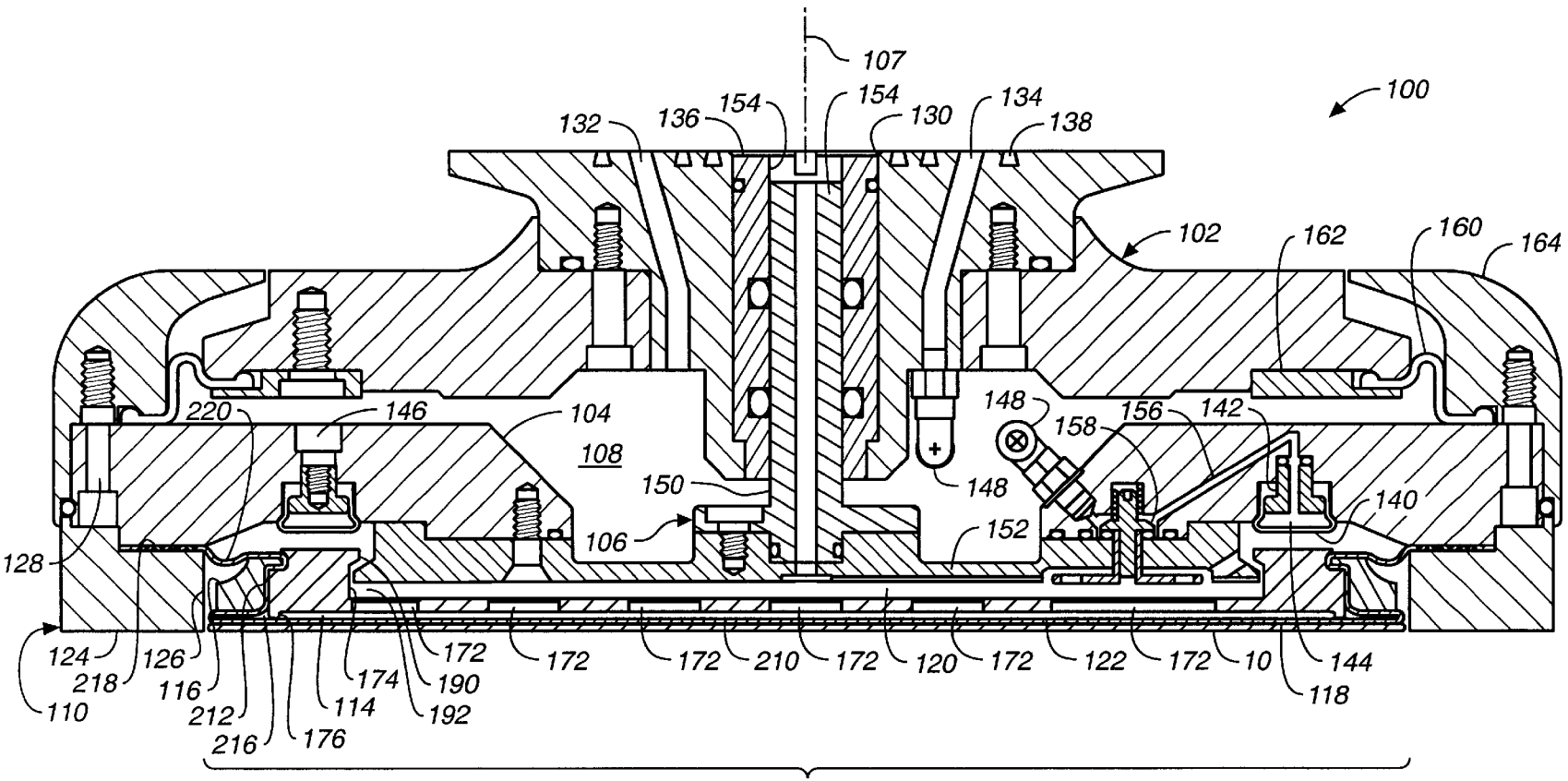
FIG. 2 is a schematic cross-sectional view of a carrier head according to the present invention.
Figure 3A:
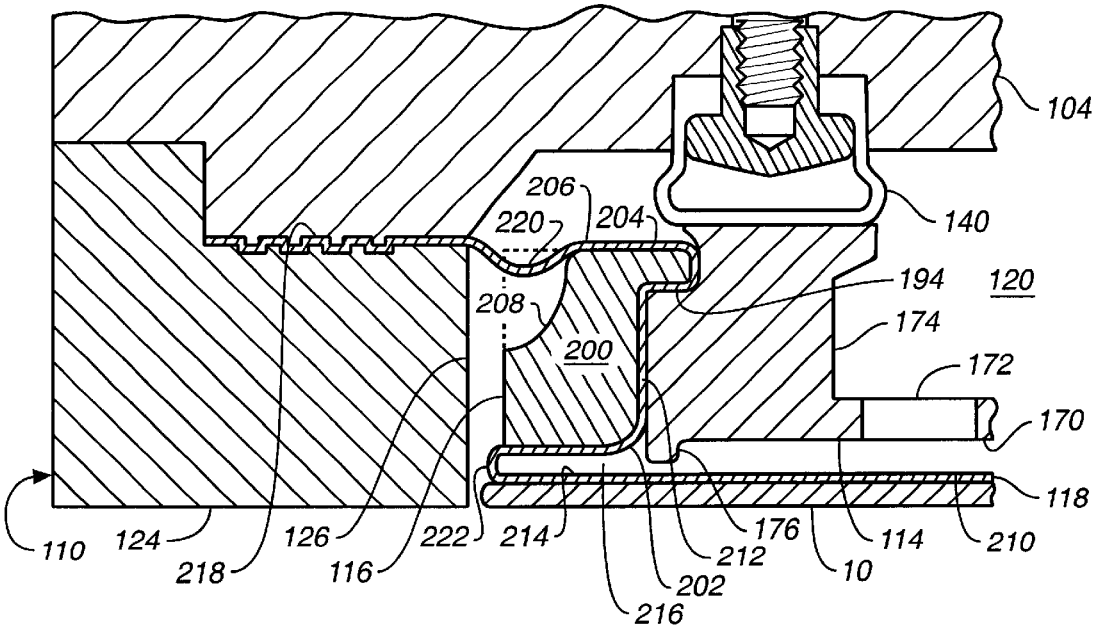
FIG. 3A is an enlarged view of the carrier head of FIG. 2 showing a flexible membrane and a spacer ring.

Referring to FIGS. 2–3, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/745,670 by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference.

Housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A vertical bore 130 may be formed through the housing, and two passages 132 and 134 may extend through the housing for pneumatic control of the carrier head. An optional bushing 136 may be position in vertical bore 130. O-rings 138 may be used to form fluid-tight seals between the passages through the housing and passages through the drive shaft.

Base 104 is a generally rigid ring-shaped or disk-shaped body located beneath housing 102. An elastic and flexible membrane 140 may be attached to the lower surface of base 104 by a clamp ring 142 to define a bladder 144. Clamp ring 142 may be secured to base 104 by screws or bolts 146. A passage 156 may extend through the clamp ring and the base, and two fixtures 148 may provide attachment points to connect a flexible tube between housing 102 and base 104 to fluidly couple passage 134 to bladder 144. A first pump (not shown) may be connected to passage 134 to direct a fluid, e.g., a gas, such as air, into or out of the bladder. An actuatable valve 158 may be positioned across passage 156 to sense the presence of a substrate, as described in U.S. application Ser. No. 08/862,350, by Boris Govzman et al., filed May 23, 1997, entitled A CARRIER HEAD WITH A SUBSTRATE DETECTION SYSTEM FOR A CHEMICAL MECHANICAL POLISHING SYSTEM, and assigned to the assignee of the present invention, the entire disclosure of which is incorporated herein by reference.

Loading chamber 108 is located between housing 102 and base 104 to apply a load, i.e., a downward pressure, to base 104. The vertical position of base 104 relative to polishing pad 32 is also controlled by loading chamber 108.

Gimbal mechanism 106, which may be considered to be part of base 104, permits the base to pivot with respect to housing 102 so that the base may remain substantially parallel with the surface of the polishing pad. Gimbal mechanism 106 includes a gimbal rod 150 which fits into vertical bore 130 and a flexure ring 152 which is secured to base 104. Gimbal rod 150 may slide vertically in bushing 136 to provide vertical motion of base 104, but it prevents any lateral motion of base 104 with respect to housing 102. Gimbal rod 150 may include a passage 154 that extends the length of the gimbal rod.

An inner edge of a generally ring-shaped rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. A second pump (not shown) may be fluidly connected to loading chamber 108 by passage 132 to control the pressure in the loading chamber and the load applied to base 104.

Retaining ring 110 may be a generally annular ring secured at the outer edge of base 104, e.g., by bolts 128. When fluid is pumped into loading chamber 108 and base 104 is pushed downwardly, retaining ring 110 is also pushed downwardly to apply a load to polishing pad 32. A bottom surface 124 of retaining ring 110 may be substantially flat, or it may have a plurality of channels to facilitate transport of slurry from outside the retaining ring to the substrate. An inner surface 126 of retaining ring 110 engages the substrate to prevent it from escaping from beneath the carrier head.

Substrate backing assembly 112 includes a support structure 114, a flexible member or membrane 118, and a spacer ring 116. A central portion 210 of flexible membrane 118 extends below support structure 114 to provide a mounting surface 122 to engage the substrate. A perimeter portion 212 of the flexible membrane extends in a serpentine path between support structure 114 and spacer ring 116 to be secured to the carrier head, e.g., to base 104 or retaining ring 110. The sealed volume between flexible membrane 118 and base 104 defines a pressurizable chamber 120. A third pump (not shown) may be fluidly connected to chamber 120 by passage 154 to control the pressure in chamber 120 and thus the downward force of the mounting surface on the substrate. In addition, chamber 120 may be evacuated to pull flexible membrane 118 upwardly and thereby vacuum-chuck the substrate to the carrier head.

Support structure 114 is located inside chamber 120 to provide a rigid support for the substrate during substrate chucking, to limit the upward motion of the substrate and flexible membrane when chamber 120 is evacuated, and to maintain the desired shape of flexible membrane 118. Specifically, support structure 114 may be a generally rigid member having a disk-shaped plate portion 170 with a plurality of apertures 172 formed therethrough, and a generally annular flange portion 174 that extends upwardly from plate portion 170. In addition, plate portion 170 may have a downwardly-projecting lip 176 at its outer edge. Support structure 114 may be "free-floating", i.e., not secured to the rest of the carrier head, and may be held in place by the flexible membrane.

Flange portion 174 of support structure 114 may include a rim 190 that extends over a ledge 192 formed in base 104. When polishing is complete and loading chamber 108 is evacuated to lift base 104 away from the polishing pad, and chamber 120 is either pressurized or vented, the lower surface of rim 190 engages ledge 192 to act as a hard stop that limits the downward motion of support structure 114 and prevents overextension of the flexible membrane.

Spacer ring 116 is a generally annular member positioned between retaining ring 110 and support structure 114. Spacer ring 116 includes a main portion 200 with a substantially flat lower surface 202, and flange portion 204 with a substantially flat upper surface 206. Flange portion 204 extends inwardly to project over a ledge 194 in the support structure. A notch 208 may be formed in the outer, upper edge of the main portion of the spacer ring.

Flexible membrane 118 is a generally circular sheet formed of a flexible and elastic material. As noted, central portion 210 of the flexible membrane defines mounting surface 122, whereas perimeter portion 212 extends between support structure 114 and spacer ring 116 to be clamped between base 104 and retaining ring 110. Specifically, perimeter portion 212 extends inwardly from the rim of central portion 210, upwardly along the outer surface of the support structure, and then outwardly along upper surface 206 of spacer ring 116. The folded region of the flexible membrane beneath spacer ring 116 forms an expandable lip portion 214 with a pressurizable pocket 216. The lip portion 214 may be used in vacuum-chucking of the substrate to the carrier head, as described in pending U.S. application Ser. No 09/296,935, filed Apr. 22, 1999, the entire disclosure of which is incorporated herein by reference. The flexible membrane 118 may terminate in a rim portion 218 which is clamped between base 104 and retaining ring 110 to form a fluid-tight seal. A "free span" portion 220 of the flexible membrane extends between rim portion 218 and the outer diameter of the upper surface of spacer ring 116. The flexible membrane may be pre-molded into a serpentine shape.

In operation, fluid is pumped into chamber 120 to control the downward pressure applied to the substrate by flexible membrane 118. When polishing is finished, chamber 108 is evacuated to lift base 104 and support structure 114 away from the polishing pad. Bladder 144 may be used to cause lip 176 of plate portion 170 to press flexible membrane 118 against substrate 10 to creating a fluid-tight seal for vacuum-chucking.

Figure 3B:
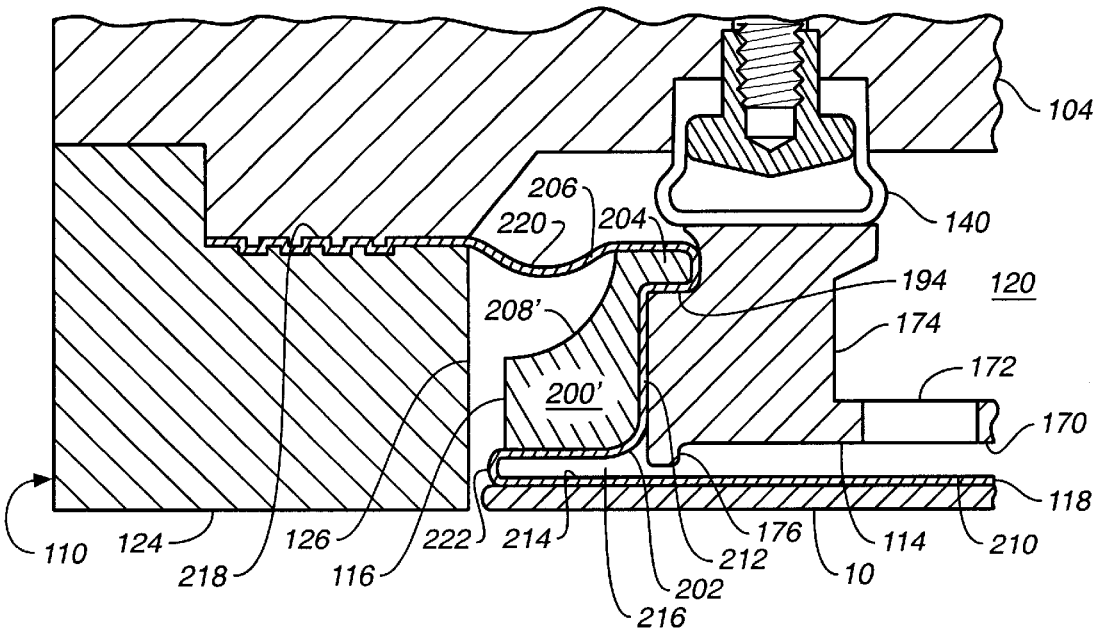
FIG. 3B is a cross-sectional view of a carrier head in which the spacer ring has a wider indentation.
Figure 3C:
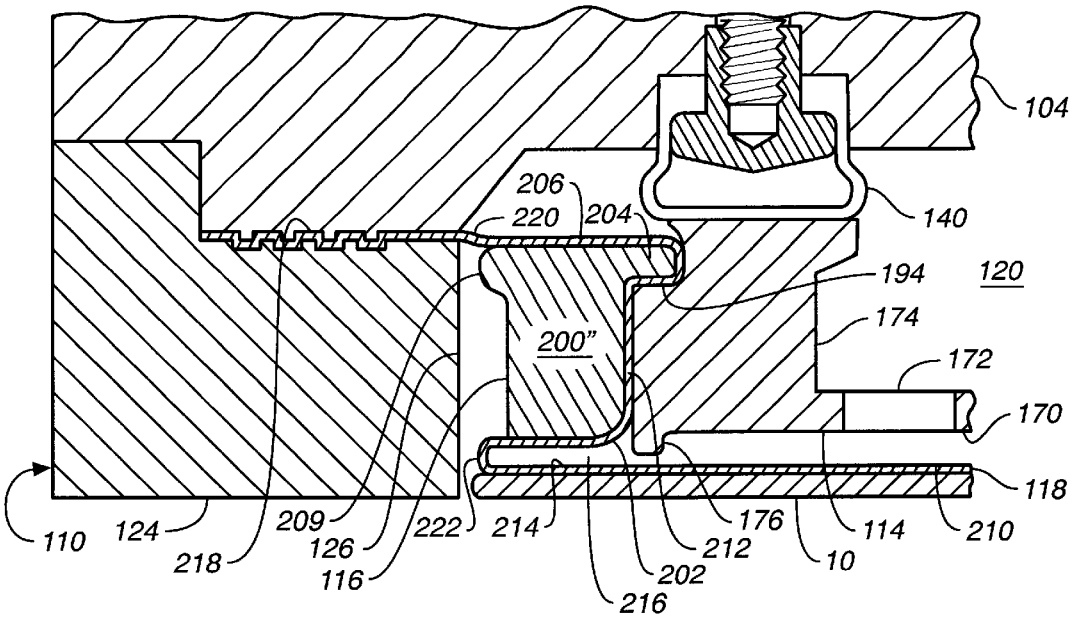
FIG. 3C is a cross-sectional view of a carrier head in which the spacer ring has a flange.

As previously discussed, one reoccurring problem in CMP is non-uniform polishing near the edge of the substrate. However, the shapes of spacer ring 116 and retaining ring 110 may be selected to control the pressure distribution applied by flexible membrane 118 near the substrate edge. In general, spacer ring 116 will transfer the pressure in chamber 120 to the corner 222 of the flexible membrane. Moreover, part of the force on the free span portion 220 will be transferred to spacer ring 116, and part will be reacted out by retaining ring 110. By appropriately selecting the ratio of the surface area of upper surface 206 to the surface area of lower surface 202 of spacer ring 116, the relative pressure applied at the corner of flexible membrane 118 to the substrate perimeter may be adjusted to reduce non-uniform polishing. By increasing the surface area of upper surface 202, e.g., by decreasing or eliminating the notch as shown by the phantom line, or even adding an outwardly projecting flange 209 to spacer ring 200", as shown in FIG. 3C, the pressure on the substrate edge is increased and the pressure on the retaining ring is decreased. Conversely, by decreasing the surface area of upper surface 208, e.g., by increasing the size of notch 208' in spacer ring 200', as shown in FIG. 3B, the pressure on the retaining ring is increased and the pressure on the substrate edge is decreased. In fact, the corner of the membrane may lift away from substrate edge. The optimal surface area of upper surface 206 of spacer ring 116 to minimize the edge effect may be determined experimentally. An advantage of this configuration is that chamber 120 can be used to adjust the pressure, and thus the polishing rates, at the center and edge of the substrate. With only a single pressure chamber, variation in applied pressure is less likely.

Figure 4:
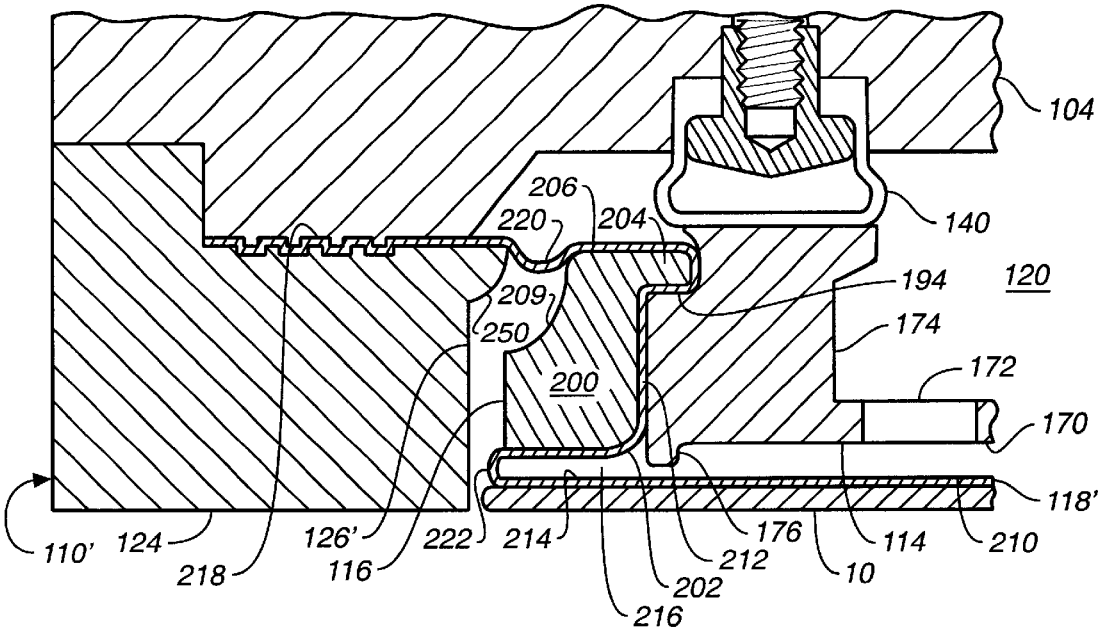
FIG. 4 is a cross-sectional view of a carrier head that includes a retaining ring with a membrane support flange.

The length and position of the free-span portion 220 will also affect the edge polishing. If free-span portion 220 is too short, it will be too stiff, and consequently the load at the edge will increase as the retaining ring wears. On the other hand, if free-span portion 220 is too long, it will sag, and some of the free-span portion will contact the spacer ring. If the center of the free-span portion is located inside the edge of the substrate, the contact diameter between the membrane and substrate will be less than the substrate diameter. On the other hand, if the center of the free-span portion is located outside the edge of the substrate, the flexible membrane will contact the entire back surface of the substrate. The contact area between the flexible membrane and the top surface of the spacer ring needs to remain constant In addition, the surface are of the top surface of the retaining ring can be selected to adjust the net force at the corner of the flexible membrane. For example, referring to FIG. 4, retaining ring 110' may include a support flange 250 that projects inwardly from inner surface 126'. Flexure support flange 250 is positioned to support a portion of flexure membrane 118' that is not clamped between retaining ring 110' and base 104. In operation, when fluid is pumped into chamber 120, a portion of the downward pressure on free span portion 220 is directed to retaining ring 110' by support flange 250. Consequently, less downward force is exerted on spacer ring 116, thereby decreasing the downward force on the corner of the membrane and the pressure applied to the perimeter portion of the substrate.

Figure 5:
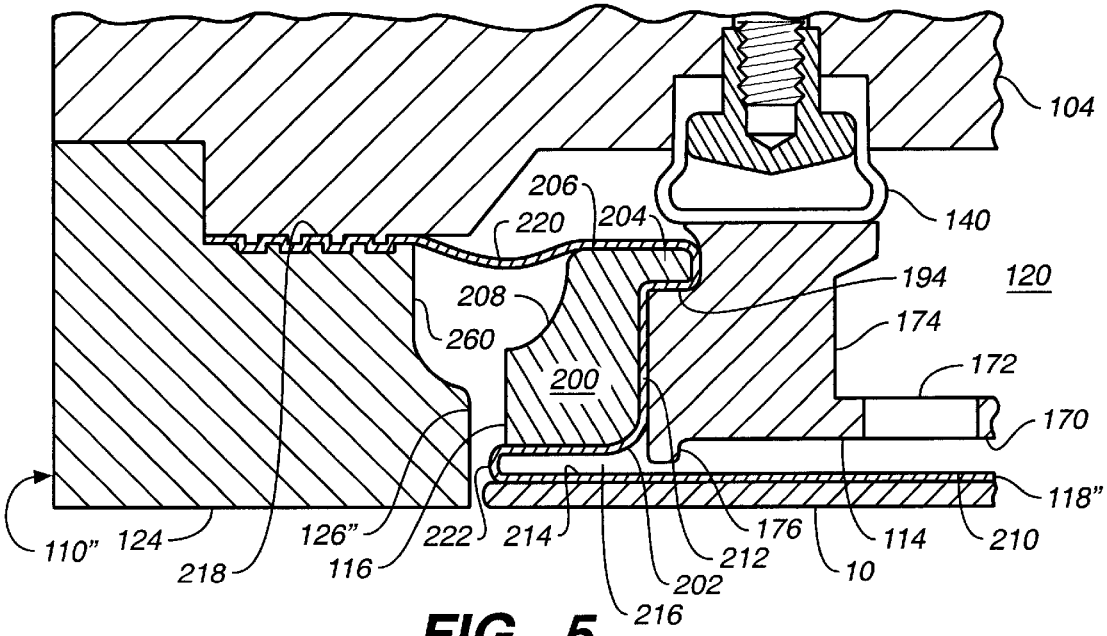
FIG. 5 is a cross-sectional view of a carrier head that includes a retaining ring with an indentation.

Conversely, referring to FIG. 5, by providing an indentation 260 in the upper edge of inner surface 126" of retaining ring 110", less of the downward force on free span portion 220" of flexible membrane 118" is reacted out. Consequently, more downward force is exerted on spacer ring 116, thereby increasing the downward force on the corner of the membrane and the pressure applied to the perimeter portion of the substrate.

Instead of or in addition to a spacer ring, the carrier head could include an edge load ring, as described in pending U.S. application Ser. No. 09/200,492, filed Nov. 25, 1998, assigned to the assignee of the present invention, the entire disclosure of which is incorporated herein by reference. In this case, an indentation or a flange could be formed in either the retaining ring or the edge load ring.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus comprising:

a base;

a retaining ring secured to the base;

an annular spacer positioned beneath the base;

a first flexible membrane portion extending beneath the base and the spacer to define a pressurizable chamber, a lower surface of the first membrane portion providing a mounting surface for a substrate; and a second flexible membrane portion extending over the spacer and having an edge portion secured between the base and the retaining ring, wherein the retaining ring includes at least one of a projection and an indentation positioned adjacent the second membrane portion to adjust the pressure applied at a perimeter of the first membrane portion.

2. The carrier head of claim 1, wherein the first and second membrane portions are portions of a single flexible membrane.

3. The carrier head of claim 2, wherein the flexible membrane extends inwardly beneath a lower surface of the spacer, upwardly around an inner surface of the spacer, and outwardly above an upper surface of the spacer.

4. The carrier head of claim 3, wherein a volume between the first membrane portion and the portion of the flexible membrane that-extends inwardly beneath the lower surface of the spacer defines a pressurizable pocket.

5. The carrier head of claim 1, further comprising a support structure positioned inside the chamber.

6. The carrier head of claim 5, wherein the spacer includes a flange that extends over the support structure.

7. The carrier head of claim 1, wherein the retaining ring includes a projection positioned adjacent the second membrane portion.

8. The carrier head of claim 1, wherein the retaining ring includes an indentation positioned adjacent the second membrane portion.

9. The carrier head of claim 1, wherein the spacer includes a projection positioned adjacent the second membrane portion.

10. The carrier head of claim 1, wherein the spacer includes an indentation positioned adjacent the second membrane portion.

11. A carrier head for a chemical mechanical polishing apparatus, comprising:

a base;

a retaining ring secured to the base;

a first flexible membrane portion extending beneath the base to define a pressurizable chamber, a first lower surface of the first membrane portion providing a mounting surface for a substrate;

an support structure positioned beneath the base inside the chamber;

an annular spacer positioned beneath the base outside the chamber between the retaining ring and support structure, the annular spacer having a second lower surface to contact the first membrane portion;

a second flexible membrane portion extending over the spacer and having an edge portion secured between the base and the retaining ring, wherein the spacer includes a annular indentation extending radially inwardly past an outer rim of the second lower surface.

12. The carrier head of claim 5, wherein the spacer is positioned outside the chamber.

13. The carrier head of claim 12, at least one of the first and second membrane portions extends between the spacer and the support structure.

14. The carrier head of claim 7, wherein the projection comprises an annular flange extending radially inwardly toward the spacer.

15. The carrier head of claim 7, wherein the chamber extends over the projection adjacent to the second membrane portion.

16. The carrier head of claim 8, wherein the indentation comprises an annular recess extending radially outwardly away from the spacer.

17. The carrier head of claim 8, wherein the base extends over the indentation adjacent to the second membrane portion.

18. A carrier head for a chemical mechanical polishing apparatus, comprising:

a base;

a retaining ring secured to the base;

an annular spacer positioned beneath the base;

a first flexible membrane portion extending beneath the base and the spacer to define a pressurizable chamber, a first lower surface of the first membrane portion providing a mounting surface for a substrate; and a second flexible membrane portion extending over the spacer and having an edge portion secured between the base and the retaining ring, wherein the spacer includes a second lower surface to contact the first flexible membrane portion and a radial annular projection extending outwardly beyond an outer rim of the second lower surface toward the retaining ring.

19. The carrier head of claim 18, further comprising a support structure positioned inside the chamber, and wherein the spacer is positioned outside the chamber.

20. The carrier head of claim 18, wherein the first and second membrane portions are portions of a single flexible membrane.

21. The carrier head of claim 11, wherein the first and second membrane portions are portions of a single flexible membrane.

22. The carrier head of claim 21, wherein the flexible membrane extends inwardly beneath a lower surface of the spacer, upwardly around an inner surface of the spacer, and outwardly above an upper surface of the spacer.

23. The carrier head of claim 22, wherein a volume between the first membrane portion and the portion of the flexible membrane that extends inwardly beneath the lower surface of the spacer defines a pressurizable pocket.

24. The carrier head of claim 1, further comprising a support structure positioned inside the chamber.

25. The carrier head of claim 24, wherein the spacer includes a flange that extends over the support structure.

26. The carrier head of claim 11, wherein the spacer is positioned outside the chamber.

* * * * *